US010253548B2

(12) United States Patent
Kaino

(10) Patent No.: US 10,253,548 B2
(45) Date of Patent: Apr. 9, 2019

(54) OPENING AND CLOSING BODY CONTROL DEVICE FOR VEHICLE

(71) Applicant: Aisin Seiki Kabushiki Kaisha, Kariya-shi (JP)

(72) Inventor: Takashi Kaino, Anjo (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 259 days.

(21) Appl. No.: 15/229,150

(22) Filed: Aug. 5, 2016

(65) Prior Publication Data

US 2017/0081899 A1 Mar. 23, 2017

(30) Foreign Application Priority Data

Sep. 17, 2015 (JP) ..... 2015-184425

(51) Int. Cl.

| | |
|---|---|
| ***E05F 15/70*** | (2015.01) |
| ***E06B 3/46*** | (2006.01) |
| ***E05F 15/655*** | (2015.01) |
| ***E05F 15/42*** | (2015.01) |
| ***E05F 15/659*** | (2015.01) |

(52) U.S. Cl.

CPC ..... *E06B 3/4636* (2013.01); *E05F 15/42* (2015.01); *E05F 15/655* (2015.01); *E05F 15/659* (2015.01); *E05Y 2400/36* (2013.01); *E05Y 2400/40* (2013.01); *E05Y 2900/531* (2013.01)

(58) Field of Classification Search

CPC ..... E05F 15/70

USPC ..... 318/280, 281, 283

See application file for complete search history.

(56) References Cited

U.S. PATENT DOCUMENTS

| | | | | |
|---|---|---|---|---|
| 6,100,658 | A * | 8/2000 | Kume | B60J 7/0573 318/266 |
| 6,906,482 | B2 * | 6/2005 | Shimizu | H02H 7/0851 318/286 |
| 7,859,204 | B2 * | 12/2010 | Sakai | G05B 13/024 318/265 |

FOREIGN PATENT DOCUMENTS

| | | |
|---|---|---|
| JP | 2000-240352 | 9/2000 |
| JP | 2002-106252 | 4/2002 |
| JP | 4736767 | 7/2011 |

* cited by examiner

*Primary Examiner* — David Luo

(74) *Attorney, Agent, or Firm* — Oblon, McClelland, Maier & Neustadt, L.L.P.

(57) ABSTRACT

An opening and closing body control device for a vehicle includes a drive control portion operating a drive control of an opening and closing body by controlling an operation of a drive device, a window portion open state determination portion determining whether a window portion being provided at the opening and closing body is open, and a moved position determination portion determining whether a moved position of the opening and closing body is within a preset specific opening movement range. The drive control portion performs a movement speed reduction control reducing a movement speed of the opening and closing body so as not to exceed a predetermined speed in a case where the moved position of the opening and closing body is within the specific opening movement range.

6 Claims, 6 Drawing Sheets

FIG. 5

Control mode of sliding door when window is open

| | Close to fully-closed position (Xc～X1) | Specific opening operation range (R : X1～X2) | Close to fully-open position (X2～Xo) |
|---|---|---|---|
| Moving in opening direction (Manual operation) | Pre-entrance stop control | Movement speed reduction control | Normal (No movement speed reduction) |
| Moving in opening direction (Opening drive control) | Continuation of opening drive control & Pre-entrance stop control | Stop of opening drive control & Movement speed reduction control | Continuation of opening drive control |
| Opening operation request inputted | Operation of opening drive control & Pre-entrance stop control | Prohibition of opening drive control | Operation of opening drive control |
| When catch occurs during the movement in opening direction | Reverse drive control | Prohibition of reverse drive control & Movement speed reduction control | Reverse drive control |

FIG. 6

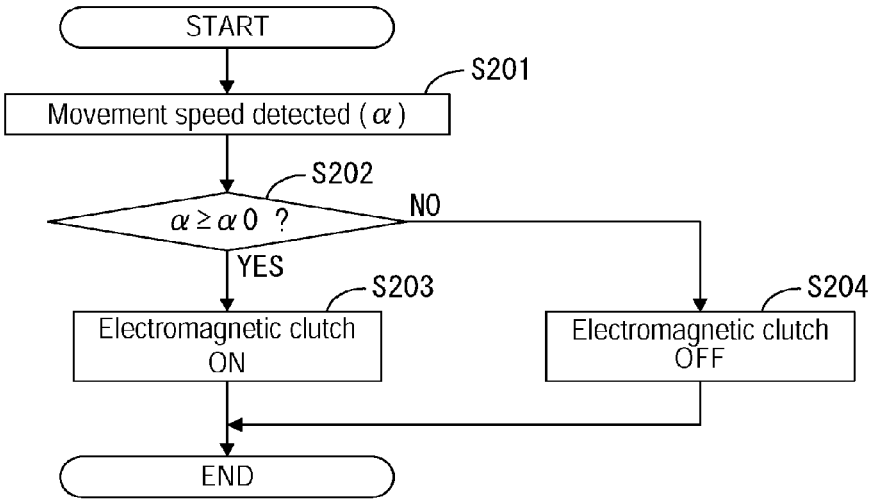

OPENING AND CLOSING BODY CONTROL DEVICE FOR VEHICLE

CROSS REFERENCE TO RELATED APPLICATIONS

This application is based on and claims priority under 35 U.S.C. § 119 to Japanese Patent Application 2015-184425, filed on Sep. 17, 2015, the entire content of which is incorporated herein by reference.

TECHNICAL FIELD

This disclosure generally relates to an opening and closing body control device for a vehicle.

BACKGROUND DISCUSSION

A known opening and closing body, for example, a sliding door, being provided at an opening portion of a vehicle body includes a window portion that performs an opening operation. For example, an opening and closing control device is described in JP2000-240352A (hereinafter, referred to as Patent reference 1). The opening and closing control device stops the movement of the sliding door before a fully-open position of the sliding door in a case where the window portion (a side window) provided at the sliding door is in an open state.

That is, in case of opening the sliding door while the window portion is open, an extraneous material (for example, a hand or a head of a passenger) extending toward outside of a vehicle via the window portion may be caught, or caught between a window frame of the window portion and a peripheral rim portion of a door opening portion, that is, a vehicle body. The opening and closing control device disclosed in Patent reference 1 stops the movement of the sliding door moving in the opening direction at a predetermined position that is preset close to the fully-open position. By retaining the sliding door at the position, the opening and closing control device may inhibit the extraneous material from being caught.

However, according to the opening and closing control device disclosed in Patent reference 1, the window portion that is in an open state is desired to be closed, or the sliding door is desired to be released from a retention control by the operation of a switch being provided close to the sliding door. Accordingly, the convenience of the sliding door for a user is reduced.

A need thus exists for an opening and closing body control device for a vehicle which is not susceptible to the drawback mentioned above.

SUMMARY

According to an aspect of this disclosure, an opening and closing body control device for the vehicle includes a moved position detecting portion detecting a moved position of an opening and closing body being provided at an opening portion of a vehicle body, a drive control portion operating a drive control of the opening and closing body by controlling an operation of a drive device, a window portion open state determination portion determining whether a window portion being provided at the opening and closing body is in an open state, and a moved position determination portion determining whether the moved position of the opening and closing body is within a preset specific opening movement range. The drive control portion performs a movement speed reduction control reducing a movement speed of the opening and closing body so as not to exceed a predetermined speed in a case where the moved position of the opening and closing body is within the specific opening movement range.

BRIEF DESCRIPTION OF THE DRAWINGS

The foregoing and additional features and characteristics of this disclosure will become more apparent from the following detailed description considered with the reference to the accompanying drawings, wherein:

FIG. 5 is an explanatory view illustrating a control mode of the sliding door when the window portion is in an open state;

FIG. 6 is a flowchart illustrating operation procedures of a reduction control of a movement speed;

DETAILED DESCRIPTION

Figure 1:
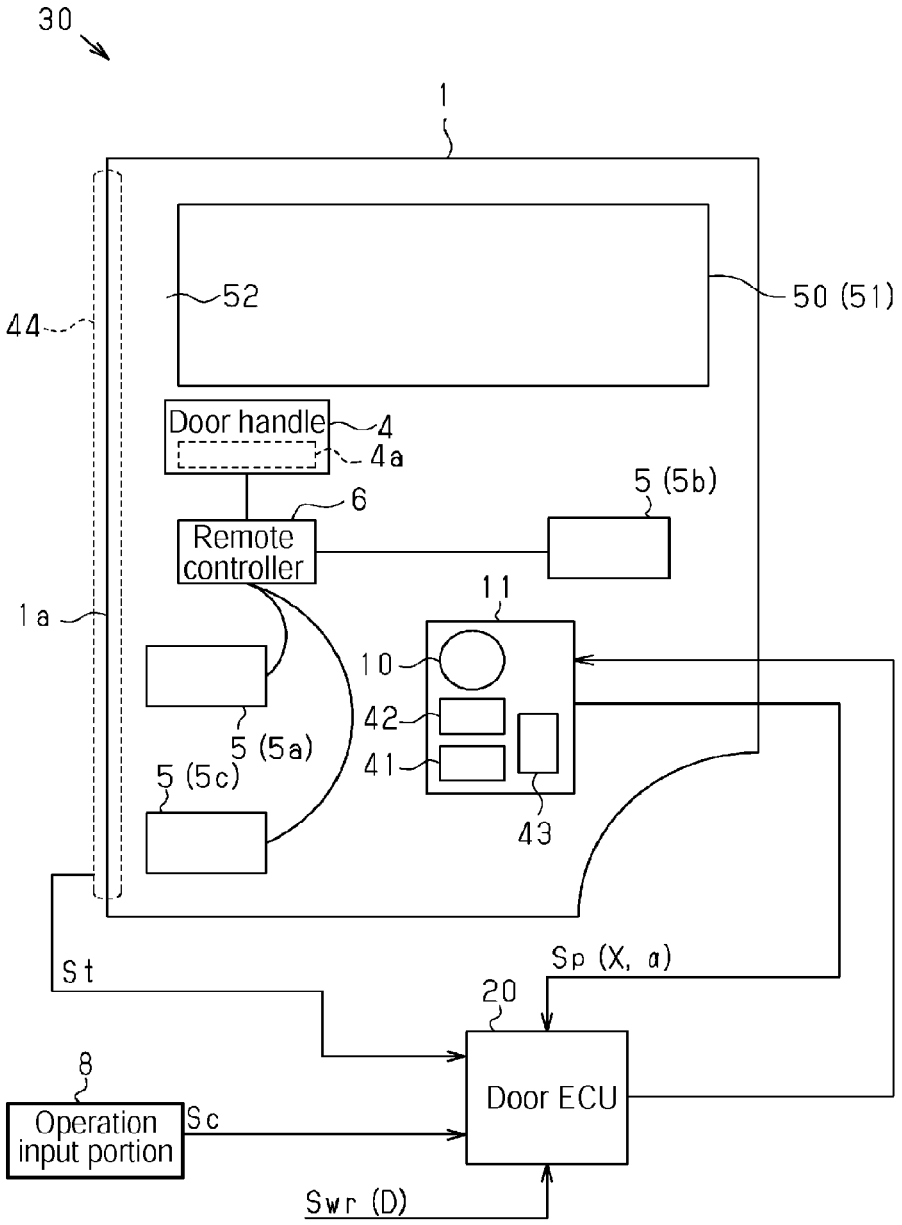
FIG. 1 is a schematic view of a power sliding door device disclosed here.
Figure 2:
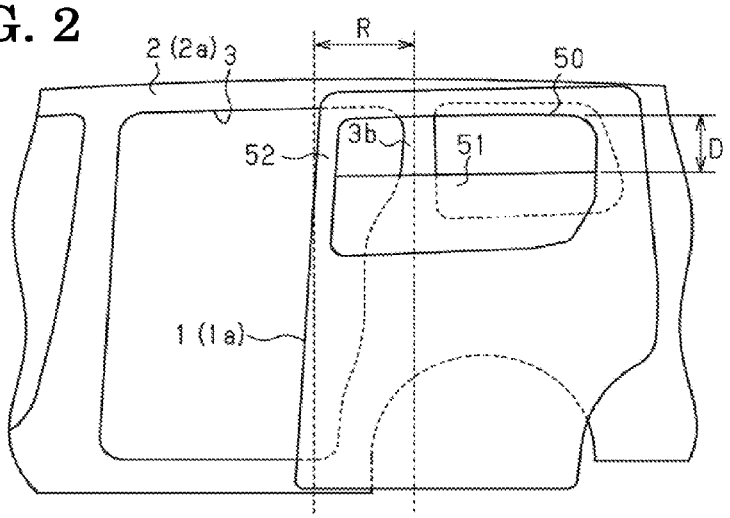
FIG. 2 is a side view of a vehicle illustrating a sliding door that moves in an opening direction while a window portion is open.

Hereinafter, an embodiment of a power sliding door device that embodies an opening and closing body control device for a vehicle will be explained with reference to the drawings. As shown in FIGS. 1 and 2, a sliding door 1 (i.e., serving as an opening and closing body) opens and closes a door opening portion 3 provided at a side surface 2*a* of a vehicle body 2 by moving in front-rear directions while being supported at the side surface 2*a* of the vehicle body 2. Specifically, the sliding door 1 closes the door opening portion 3 (fully-closed state) by moving in a front direction of the vehicle (left in FIGS. 1 and 2). The sliding door 1 comes to be in a fully-open state that allows passengers to get on and off the vehicle via the door opening portion 3 by moving in a rear direction of the vehicle (right in FIGS. 1 and 2). The slide door 1 includes a door handle 4 for opening and closing the sliding door 1.

As shown in FIG. 1, the sliding door 1 includes plural lock devices 5 including a known latch mechanism that engages with a striker provided at the vehicle body in accordance with a moved position of the sliding door 1. Specifically, the sliding door 1 includes a front lock 5*a* and a rear lock 5*b* that allow a fully-closed lock retaining the sliding door 1 at the fully-closed position. Moreover, the sliding door 1 includes a fully-open lock 5*c* for retaining the sliding door 1 at the fully-open position. The lock devices 5 are connected to the door handle 4 via a remote controller 6.

That is, the sliding door 1 of the embodiment releases a lock by the lock devices 5 by the operation of an operation portion 4*a* (an outer handle and an inner handle) of the door handle 4. The sliding door 1 may release the lock by the lock devices 5 by the operation of an operation switch provided at an interior of the vehicle and an operation input portion 8, for example, a mobile device. The sliding door 1 of the embodiment opens and closes manually by having the door handle 4 that serves as a grip portion.

The sliding door 1 of the embodiment is provided with a drive device 11 including a motor 10 that serves as a drive source. The operation of the drive device 11 is controlled by a door electric control unit 20, or a door ECU 20 (i.e., serving as a drive control portion, a window portion open state determination portion, a moved position detection portion, and a catch detection portion). According to the embodiment, a power sliding door device 30 (i.e., serving as an opening and closing body control device for a vehicle) is provided as the opening and closing body control device for the vehicle that opens and closes the sliding door 1 in response to the drive force of the motor 10.

Specifically, the drive device 11 of the embodiment includes an opening and closing drive portion 41 that allows the sliding door 1 to open and close via a drive cable by the rotation of the opening and closing drive portion 41 in response to the drive force of the motor 10. The drive device 11 includes an electromagnetic clutch 42 (i.e., serving as a clutch) that connects and disconnects the drive force of the motor 10, the drive force that is transmitted to the sliding door 1 via the opening and closing drive portion 41. Specifically, the electromagnetic clutch 42 connects a torque transmission passage between the motor 10 and the opening and closing drive portion 41 by energization (active operation). Accordingly, the power sliding door device 30 of the embodiment opens and closes the sliding door 1 smoothly even when the manual operation in which the motor 10 does not perform the drive control is performed.

More specifically, operation input signals Sc that indicate that the operation input portion 8 is operated are inputted to the door ECU 20. That is, the door ECU 20 detects an operation request of the sliding door 1 by a user in response to the operation input signals Sc. Then, the door ECU 20 controls the operation of the drive device 11 so as to move the sliding door 1 in the opening and closing directions indicated by the operation request.

In particular, the drive device 11 of the embodiment includes a pulse sensor 43 outputting pulse signals Sp that are synchronized with the movement of the opening and closing drive portion 41. The door ECU 20 of the embodiment performs the opening and closing drive controls of the sliding door 1 in response to a moved position X and a movement speed $\alpha$ of the sliding door 1 being detected by counting the pulse signals Sp.

A front end of the sliding door 1 includes a touch sensor 44 for detecting the catch of an extraneous material. According to the embodiment, the touch sensor 44 is provided within a weather strip. That is, the door ECU 20 detects that the extraneous material is caught at a front end portion 1*a* of the sliding door 1 that moves in the closing direction in response to output signals St of the touch sensor 44. In a case where the door ECU 20 detects that the extraneous material is caught, the door ECU 20 performs a reversing drive control driving the sliding door 1 in the opening direction by a predetermined amount in order to release the extraneous material from being caught.

Moreover, as shown in FIGS. 1 and 2, a window portion (side window) 50 of the sliding door 1 can be opened. Window portion opening and closed state signals Swr indicating the opening and closed state of the window portion 50 are inputted to the door ECU 20. According to the embodiment, the window portion opening and closed state signals Swr show an opening D of (a window glass 51 of) the window portion 50. The door ECU 20 detects that the window portion 50 of the sliding door 1 is in an open state in response to the window portion opening and closed state signals Swr.

Figure 3:
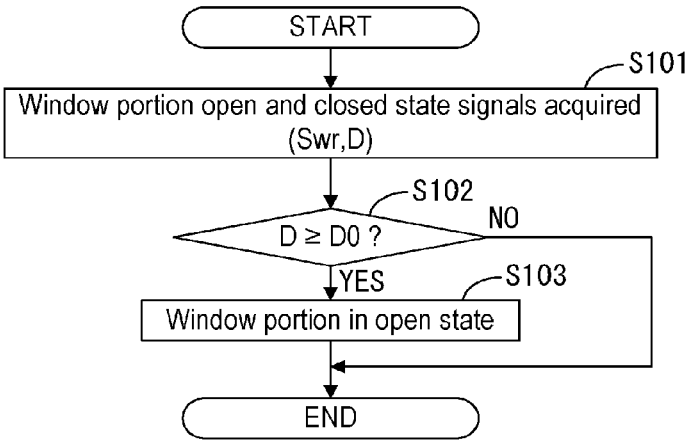
FIG. 3 is a flowchart illustrating operation procedures of a determination whether the window portion is in an open state.

In particular, as shown in a flowchart in FIG. 3, in a case where the door ECU 20 acquires the window portion opening and closing signals Swr (Step 101), the door ECU 20 determines whether the opening D of the window portion 50 indicated by the window portion opening and closed state signals Swr is equal to or greater than a threshold value D0 (Step 102). That is, according to the power sliding door device 30 of the embodiment, the door ECU 20 determines that the window portion 50 is in an open state (Step 103) in a case where the opening D of the window portion 50 is equal to or greater than the threshold value D0 (D≥D0, Step 102: YES). The door ECU 20 controls the operation of the drive device 11 to inhibit the extraneous material from being caught or caught hold between the window frame 52 of the window portion 50 that is in an open state and a rear end rim 3*b* (see FIG. 2) of the door opening portion 3, that is, the vehicle body 2 when the sliding door 1 moves in the opening direction in response to the result of the open state determination of the window portion 50.

Next, a control mode of the sliding door 1 in a case where the window portion 50 is in an open state will hereunder be explained.

Figure 4:
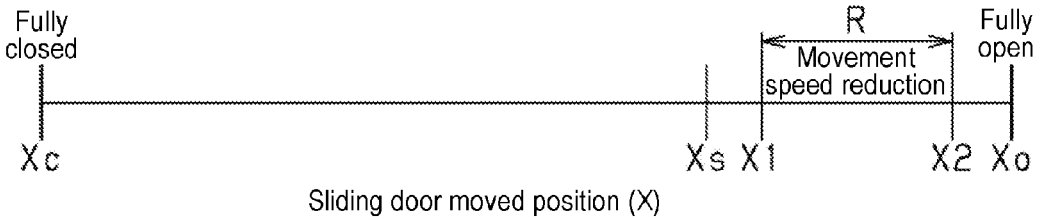
FIG. 4 is an explanatory view illustrating a specified opening movement range being set on a moving stroke of the sliding door.

As shown in FIG. 4, according to the power sliding door device 30, a range from a moved position X1 to a moved position X2 is set as a specific opening movement range R in a movement stroke of the sliding door 1 moving between a fully-closed position Xc and a fully-open position Xo. In a case where the window portion 50 of the sliding door 1 moving in the opening direction within the specific opening movement range R is in an open state, the door ECU 20 controls the operation of the drive device 11 (movement speed reduction control) to reduce the movement speed $\alpha$ of the sliding door 1 in order for the movement speed $\alpha$ of the sliding door 1 not to exceed a predetermined speed (a predetermined speed $\alpha$0).

That is, the specific opening movement range R is set close to the fully-open position Xo. The fully-open position Xo is where the extraneous material, for example, a hand or a head of a passenger, the hand or the head extending to the outside of the vehicle via the window portion 50, may be caught, or trapped between the window frame 52 of the window portion 50 and the vehicle body 2 in a case where the sliding door 1 moves in the opening direction. In a case where the power sliding door device 30 is in the aforementioned state, the power sliding door device 30 inhibits the extraneous material from being caught, or trapped by the sliding door 1 by reducing the movement speed $\alpha$ of the sliding door 1.

Specifically, as shown in FIGS. 4 and 5, in a case where the moved position X of the sliding door 1 moving in the opening direction by a manual operation is within the specific opening operation range R (X1 to X2), and in a case where the window portion 50 of the sliding door 1 is in an open state (or comes to be in an open state), the door ECU 20 reduces the movement speed $\alpha$ of the sliding door 1 by operating the movement speed reduction control.

In particular, as shown in a flowchart in FIG. 6, the movement speed reduction control of the door ECU 20 of the embodiment determines whether the movement speed $\alpha$ is equal to or faster than the predetermined speed $\alpha 0$ (Step 202) when detecting the movement speed $\alpha$ of the sliding door 1 (Step 201). In a case where the movement speed $\alpha$ of the sliding door 1 is equal to or faster than the predetermined speed $\alpha 0$ ($\alpha \geq \alpha 0$, Step 202: YES), the door ECU 20 turns on the electromagnetic clutch 42 of the drive device 11 (Step 203). In a case where the movement speed $\alpha$ is below the predetermined speed $\alpha 0$ ($\alpha < \alpha 0$, Step 202: NO), the door ECU 20 turns off the electromagnetic clutch 42 (Step 204).

That is, because the door ECU 20 turns on the electromagnetic clutch 42 to connect the torque transmission passage between the motor 10 and the opening and closing drive portion 41, for example, the door ECU 20 applies a load on the sliding door 1 to inhibit the sliding door 1 from moving in response to frictional force of, for example, a cogging torque of the motor 10 or a reduction mechanism. The power sliding door device 30 may reduce a speed of the sliding door 1 that moves faster than the predetermined speed $\alpha 0$.

As shown in FIGS. 4 and 5, the door ECU 20 performs the movement speed reduction control by stopping the opening drive control in a case where the sliding door 1 moves in the opening direction within the specific opening movement range R by the opening drive control while the window portion 50 is open. Even in a case where the door ECU 20 is inputted with the operation input signals Sc requesting the opening operation of the sliding door 1, the door ECU 20 does not perform the opening drive control of the sliding door 1 in response to the operation request in a case where the moved position X of the sliding door 1 is within the specific opening movement range R while the window portion 50 is in an open state (prevention of the opening operation).

The door ECU 20 performs a pre-entrance stop control stopping the sliding door 1 before arriving the specific opening movement range R in a case where the moved position X of the sliding door 1 moving in the opening direction by manual operation is close to the fully-open position Xc (Xc to X1) relative to the specific operation range R while the window portion 50 is open.

In particular, in a case where the moved position X of the sliding door 1 reaches a predetermined position Xs that is set close to the fully-closed position Xc relative to the moved position X1 that corresponds to an entrance position of the sliding door 1 that enters into the specific opening movement range R, the door ECU 20 stops the movement of the sliding door 1 by turning on the electromagnetic clutch 42 of the drive device 11. After the movement of the sliding door 1 is stopped, the door ECU 20 turns off the electromagnetic clutch 42.

In a case where the sliding door 1 is disposed close to the fully-closed position Xc relative to the specific opening movement range R while the window portion 50 is open, and in a case where the opening operation request of the sliding door 1 is generated, the door ECU 20 performs the opening drive control of the sliding door 1 in response to the opening operation request. Furthermore, in a case where the sliding door 1 moving in the opening direction by the opening drive control is disposed close to the fully-closed position Xc relative to the specific opening movement range R while the window portion 50 is open, the sliding door 1 continuously performs the opening drive control of the sliding door 1. In those cases, similarly to a case where the sliding door 1 moves in the opening direction by the manual operation, the door ECU 20 performs the pre-entrance stop control in addition to the opening drive control. Accordingly, the movement of the sliding door 1 moving in the opening direction may be stopped before arriving the specific opening movement range R.

That is, when the moved position X of the sliding door 1 reaches the predetermined position Xs, the door ECU 20 stops the motor drive while remaining the electromagnetic clutch 42 of the drive device 11 in an on state, that is, while maintaining the torque transmission passage between the motor 10 and the opening and closing drive portion 41 in a connected state. After the sliding door 1 is stopped, the door ECU 20 turns off the electromagnetic clutch 42.

In a case where the moved position X of the sliding door 1 is close to the fully-open position Xo (X2 to Xo) relative to the specific opening movement range R, the door ECU 20 does not perform the movement speed reduction control of the sliding door 1 even in a state where the window portion 50 is open. The door ECU 20 allows the sliding door 1 to move in the opening direction by the opening drive control.

Figure 7:
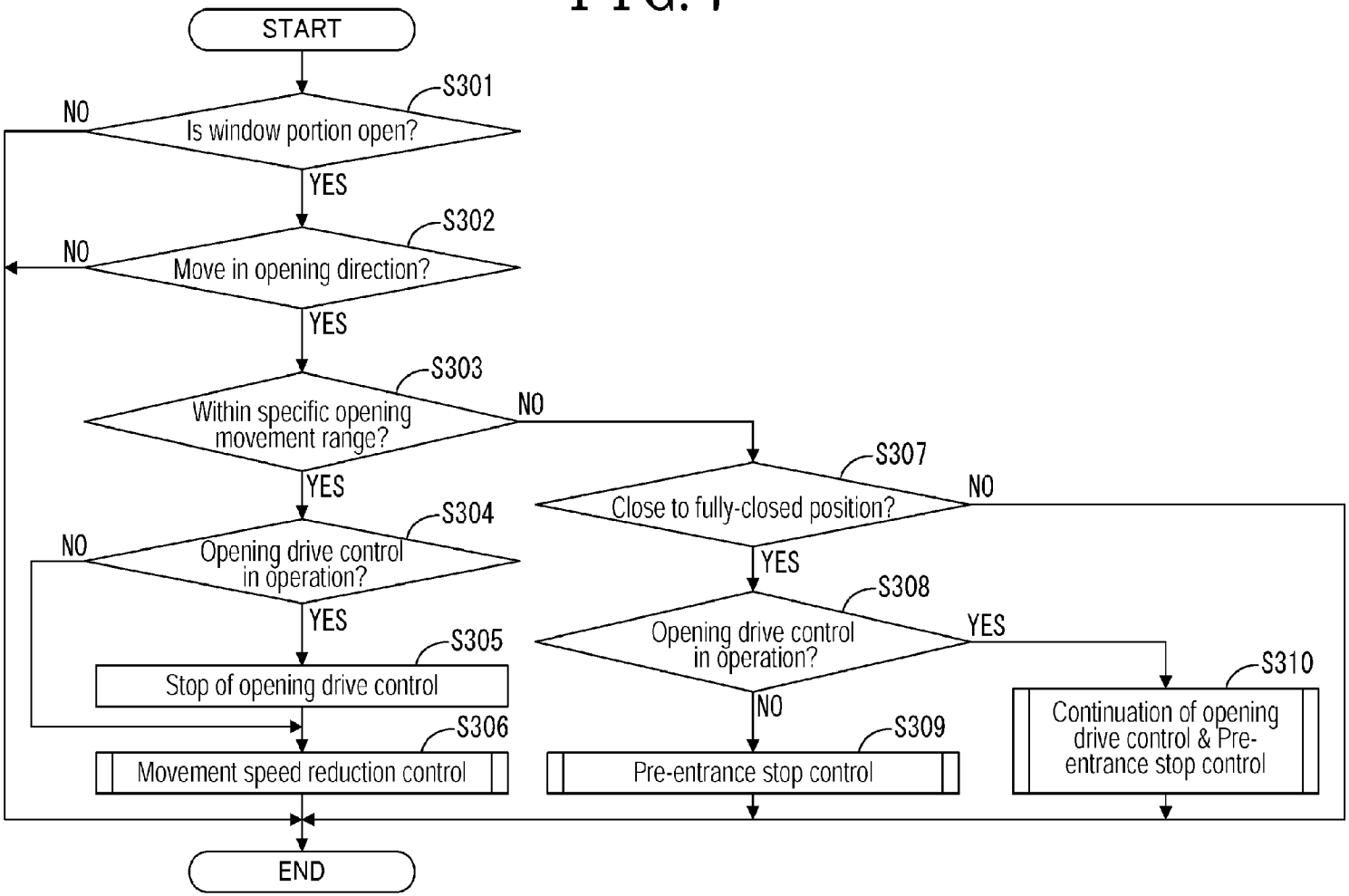
FIG. 7 is a flowchart illustrating the control mode of the sliding door when the window portion is in the open state (when the sliding door moves in the opening direction)

Specifically, as shown in a flowchart in FIG. 7, the door ECU 20 determines whether the moved position X is within the specific opening movement range R (Step 303) in a case where the sliding door 1 moves in the opening direction (Step 302: YES) while the window portion 50 is open (Step 301: YES). Furthermore, the door ECU 20 determines whether the opening drive control of the sliding door 1 is performed (Step 304) in a case where the moved position X of the sliding door 1 is within the specific opening movement range R (Step 303: YES). In a case where the opening drive control of the sliding door 1 is performed (Step 304: YES), the door ECU 20 reduces the movement speed $\alpha$ of the sliding door 1 by operating the movement speed reduction control (Step 306).

In a case where the door ECU 20 does not perform the opening drive control of the sliding door 1 in Step 304 (Step 304: NO), that is, in a case where the sliding door 1 is operated manually, the door EU 20 performs the movement speed reduction control of the sliding door 1 in Step 306 without operating Step 305.

In a case where the door ECU 20 determines that the moved position X of the sliding door 1 is not within the specific opening movement range R in Step 303 (Step 303: NO), the door ECU 20 determines whether the moved position X of the sliding door 1 is close to the fully-closed position Xc relative to the specific opening movement range R (Step 307). In a case where the door ECU 20 determines that the moved position X is close to the fully-closed position Xc relative to the specific opening movement range R, that is, in a case where the door ECU 20 determines that the sliding door 1 is disposed before arriving the specific opening movement range R (Step 307: YES), the door ECU 20 determines whether the opening drive control of the sliding door 1 is performed (Step 308). In a case where the opening drive control of the sliding door 1 is not performed (Step 308: NO), that is, in a case where the manual operation is performed, the door ECU 20 performs the pre-entrance stop control that stops the movement of the sliding door 1 before arriving the specific opening movement range R (Step 309).

In a case where the door ECU 20 performs the opening drive control of the sliding door 1 in Step 308 (Step 308: YES), the door ECU 20 continuously performs the opening drive control. The door ECU 20 performs the pre-entrance stop control along with the opening drive control of the sliding door 1 (Step 310).

In a case where the window portion 50 of the sliding door 1 is not in an open state (Step 301: No), the door ECU 20 does not operate the process in and after Step 302. In a case where the sliding door 1 does not move in the opening direction (Step 302: NO), the door ECU 20 does not operate the process in and after Step 303. In a case where the door ECU 20 determines that the moved position X of the sliding door 1 is close to the fully-open position Xo relative to the specific opening movement range R (Step 307: NO), the door ECU 20 does not operate the procedures of Steps 308 to 310.

Figure 8:
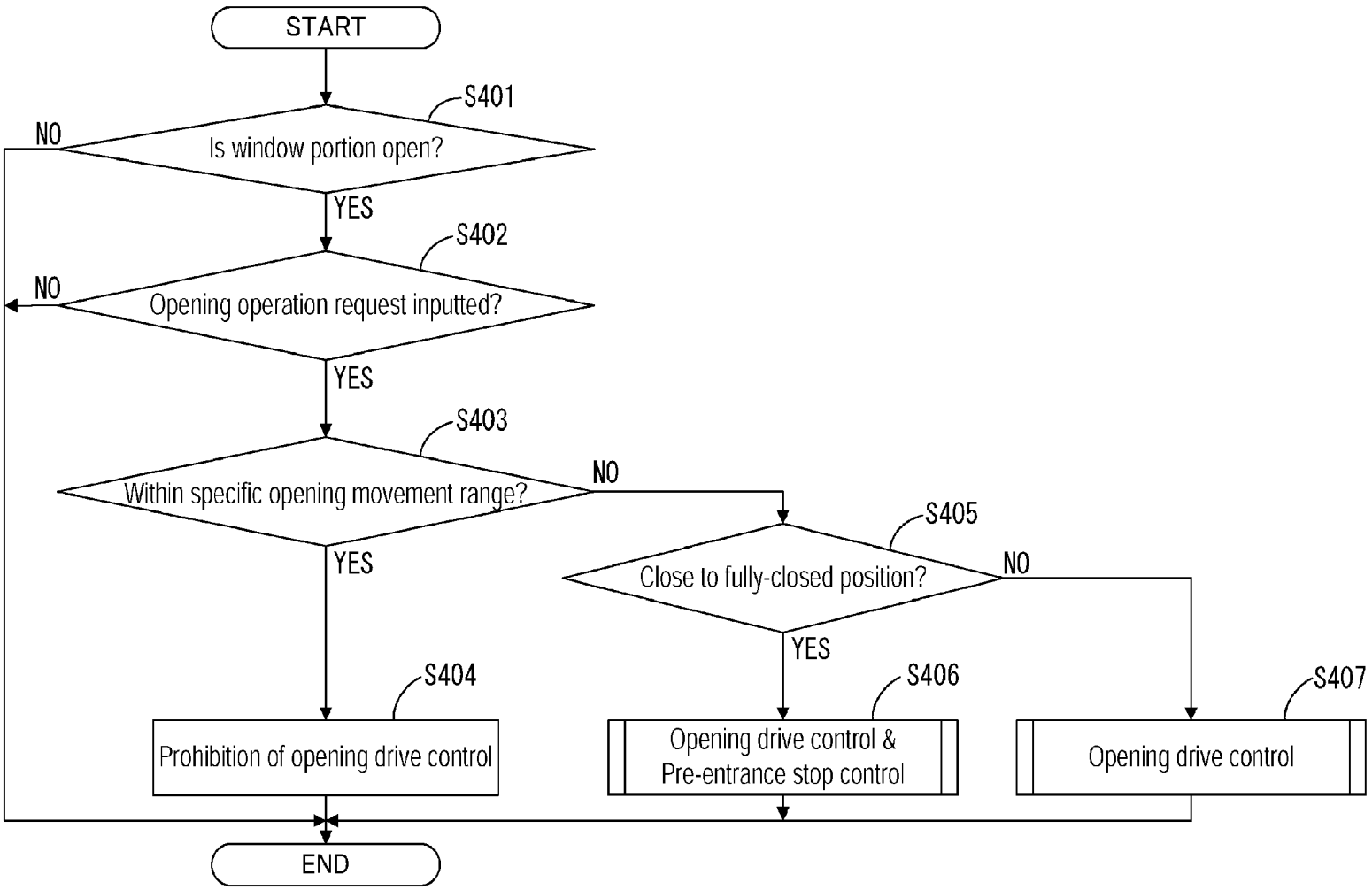
FIG. 8 is a flowchart illustrating the control mode of the sliding door when the window portion is in the open state (when an opening request is inputted)

As shown in a flowchart in FIG. 8, the door ECU 20 determines whether the moved position X of the sliding door 1 is within the specific opening movement range R (Step 403) in a case where the opening movement of the sliding door 1 is requested (Step 402: YES) while the window portion 50 is open (Step 401: YES). In a case where the movement X of the sliding door 1 is within the specific opening movement range R (Step 403: YES), the door ECU 20 prevents the sliding door 1 from opening in response to the opening movement request, that is, the door ECU 20 does not perform the opening drive control (Step 404).

The door ECU 20 determines whether the moved position X of the sliding door 1 is close to the fully-closed position Xc relative to the specific opening movement range R (Step 405) after determining that the moved position X of the sliding door 1 is not within the specific opening movement range R in Step 403 (Step 403: NO). In a case where the door ECU 20 determines that the moved position X of the sliding door 1 is close to the fully-closed position Xc relative to the specific opening movement range R (Step 405: YES), the door ECU 20 performs the opening drive control of the sliding door 1 and performs the pre-entrance stop control stopping the movement of the sliding door 1 before arriving the specific opening movement range R (Step 406).

The door ECU 20 does not operate the procedures in and after Step 402 in a case where the window portion 50 of the sliding door 1 is not in an open state (Step 401: NO). In a case where the opening operation of the sliding door 1 is not requested (Step 402: NO), the door ECU 20 does not operate the procedures in and after Step 403. In a case where the door ECU 20 determines that the moved position X of the sliding door 1 is close to the fully-open position Xo relative to the specific opening movement range R (Step 405: NO), the door ECU 20 performs the opening drive control of the sliding door 1 in response to the opening operation request (Step 407).

As shown in FIGS. 4 and 5, in a case where the moved position X of the sliding door 1 is within the specific opening movement range R while the window portion 50 of the sliding door 1 is open, the door ECU 20 does not perform a reverse drive control of the sliding door 1 even in a case where the door ECU 20 detects that the extraneous material is caught by the sliding door 1 moving in the closing direction (the prevention of the reverse drive control). The door ECU 20 performs the reduction control of the movement speed of the sliding door 1 when the sliding door 1 moves in the opening direction and in the closing direction.

That is, by not operating the reverse drive control, the door ECU 20 can prevent a new extraneous material from being caught, or caught hold between the window frame 52 of the window portion 50 that is in an open state and the vehicle body 2. Because the door ECU 20 performs the movement speed reduction control, the sliding door 1 by which the extraneous material is caught may be moved slower than the manual operation. Accordingly, the power sliding door device 30 may release the catch occurred when the sliding door 1 moves in the closing direction. Along with that, the power sliding door device 30 may inhibit the extraneous material from being caught in a case where the sliding door 1 moves in the opening direction to release the catch, and may inhibit the extraneous material from being caught again in a case where the sliding door 1 moves in the closing direction.

Figure 9:
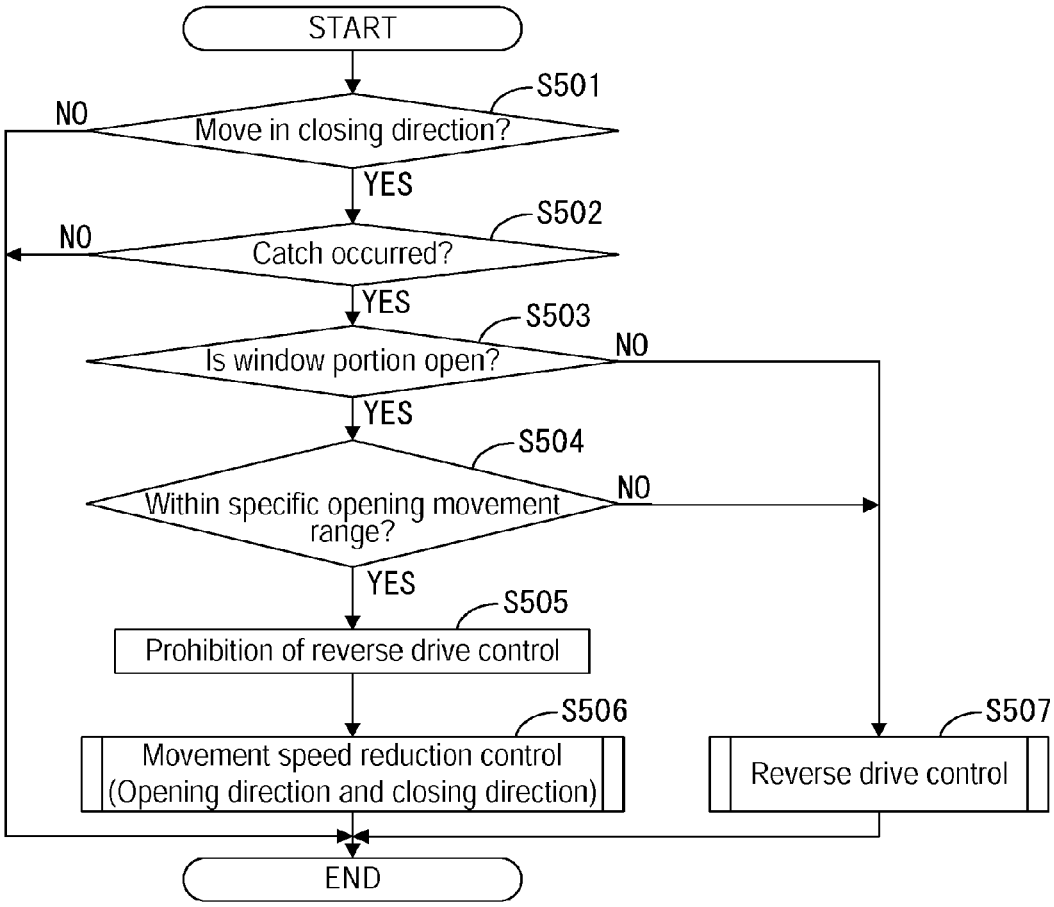
FIG. 9 is a flowchart illustrating the control mode of the sliding door when the window portion is in the open state (when an extraneous material is caught, or trapped)

Specifically, as shown in a flow chart in FIG. 9, in a case where the door ECU 20 detects the catch of the sliding door 1 when the sliding door 1 moves in the closing direction (Step 501: YES and Step 502: YES), the door ECU 20 determines whether the window portion 50 of the sliding door 1 is in an open state (Step 503). In a case where the window portion 50 is in an open state (Step 503: YES), the door ECU 20 determines whether the moved position X of the sliding door 1 is within the specific opening movement range R (Step 504). In a case where the moved position X of the sliding door 1 is within the specific opening movement range R (Step 504: YES), the door ECU 20 reduces the movement speed $\alpha$ of the sliding door 1 (Step 506) by preventing the reverse drive of the sliding door 1 (Step 505), that is, by not operating the reverse drive control when the catch occurs.

The door ECU 20 does not operate the procedures in and after Step 502 in a case where the sliding door 1 does not move in the closing direction (Step 501: NO). In a case where the door ECU 20 does not detect the catch (Step 502: NO), the door ECU 20 does not operate the procedures in and after Step 503. In a case where the window portion 50 is not in an open state in Step 503 (Step 503: NO), or in a case where the moved position X of the sliding door 1 is not within the specific opening movement range R (Step 504: NO), the door ECU 20 performs the reverse drive control of the sliding door 1 (Step 507).

According to the aforementioned embodiment, following effects and advantages may be attained.

The door ECU 20 serving as a moved position detection portion detects the moved position X of the sliding door 1 serving as an opening and closing body provided at the door opening portion 3 of the vehicle body 2. The door ECU 20 serving as a window portion open state determination portion determines whether the window portion 50 provided at the sliding door 1 is in an open state. The door ECU 20 serving as a moved position determination portion determines whether the moved position X of the sliding door 1 is within the preset specific opening movement range R. The door ECU 20 serving as a drive control portion performs the reduction control of the movement speed of the sliding door 1 such that the movement speed $\alpha$ of the sliding door 1 does not exceed the preset speed (predetermined speed $\alpha 0$) in a case where the moved position X of the sliding door 1 is within the preset specific opening movement range R while the window portion 50 is open.

According to the aforementioned construction, the door ECU 20 may inhibit the extraneous material disposed between the window frame 52 of the window portion 50 that is in an open state and the vehicle body 2 from being caught when the sliding door 1 moves in the opening direction. A gripping force, or a pressing force may be reduced even in a case where the extraneous material is caught. Because the door ECU 20 does not retain the position of the sliding door 1, the door ECU 20 may release the catch easily. Even in a case where the window portion 50 is in an open state, the door ECU 20 may move the sliding door 1 in the opening direction slowly while checking, without operating a special operation, that the extraneous material is not caught. As a result, the door ECU 20 may enhance the convenience of the sliding door 1 while inhibiting the catch occurred when the sliding door 1 moves in the opening direction while the window portion 50 is open.

The door ECU 20 performs the reduction control of the movement speed in a case where the sliding door 1 moves in the opening direction. That is, in a case where the sliding door 1 moves in the closing direction, the extraneous material is rarely caught between the window frame 52 of the window portion 50 that is in an open state and the vehicle body 2. Thus, the convenience of the sliding door 1 may be further enhanced.

The door ECU 20 does not perform the reduction control of the movement speed of the sliding door 1 in a case where the moved position X of the sliding door 1 is close to the fully-open position Xo relative to the specific opening movement range R. That is, because the sliding door 1 moves close to the fully-open position Xo and the space between the window frame 52 of the window portion 50 that is in an open state and the vehicle body 2 comes to be narrow, the extraneous material is rarely caught. Thus, according to the aforementioned embodiment, the door ECU 20 may move the sliding door 1 to the fully-open position Xo quickly while inhibiting the extraneous material from being caught. Thus, the convenience of the sliding door 1 is further enhanced.

In a case where the window portion 50 is in an open state, and in a case where the moved position X of the sliding door 1 is within the specific opening movement range R, the door ECU 20 does not perform the opening drive control of the sliding door 1 in response to the input of the opening operation request.

According to the aforementioned construction, for example, in a case where the extraneous material may be easily caught between the window frame 52 and the vehicle body 2 because, for example, the hands or the head of a passenger is out of the vehicle from the window portion 50 that is in an open state, the sliding door 1 may be prevented from being opened by an unawareness or an operation error of a user. Accordingly, the extraneous material may be inhibited from being caught by the sliding door 1.

In a case where the door ECU 20 serving as a catch detection portion and the drive control portion detects that the extraneous material is caught at the sliding door 1 that moves in the closing direction, the door ECU 20 performs the reverse drive control driving the sliding door 1 in the opening direction by a predetermined amount of the movement in order to release the extraneous material from being caught. In a case where the window portion 50 is in an open state, and in a case where the moved position X of the sliding door 1 is within the specific opening movement range R, the door ECU 20 does not perform the reverse drive control even in a case where the door ECU 20 detects that the extraneous material is caught.

According to the aforementioned construction, the extraneous material disposed between the window frame 52 of the window portion 50 that is in an open state and the vehicle body 2 may be prevented from being caught when the sliding door 1 moves in the opening direction by the reverse drive control.

In a state where the window portion 50 is in an open state, and in a case where the moved position X of the sliding door 1 is close to the fully-closed position Xc relative to the specific opening movement range R, the door ECU performs the pre-entrance stop control stopping the sliding door 1 that moves in the opening direction 1 before arriving the specific opening movement range R.

That is, because the sliding door 1 is stopped before arriving the specific opening movement range R, the extraneous material may not easily be caught by the sliding door 1 that enters into the specific opening movement range R even in a state where the window portion 50 is open. Because the door ECU 20 does not retain the position of the sliding door 1, the door ECU 20 may slowly moves the sliding door 1 in the opening direction while checking that the extraneous material is not caught without operating a special operation. Accordingly, the convenience of the sliding door 1 may be enhanced.

The aforementioned embodiment may be modified as follows.

According to the aforementioned embodiment, the power sliding door device 30 opens and closes the sliding door 1 provided at a side surface of the vehicle. Alternatively, the disclosure may be applied to an opening and closing body control device for a vehicle that is targeted on an opening and closing body other than the sliding door 1, for example, a sunroof device, as long as a vehicle includes a window portion that can open and an extraneous material may be caught between a window frame and a vehicle body by the movement of a sliding door in the opening direction while the window portion is open.

Figure 10:
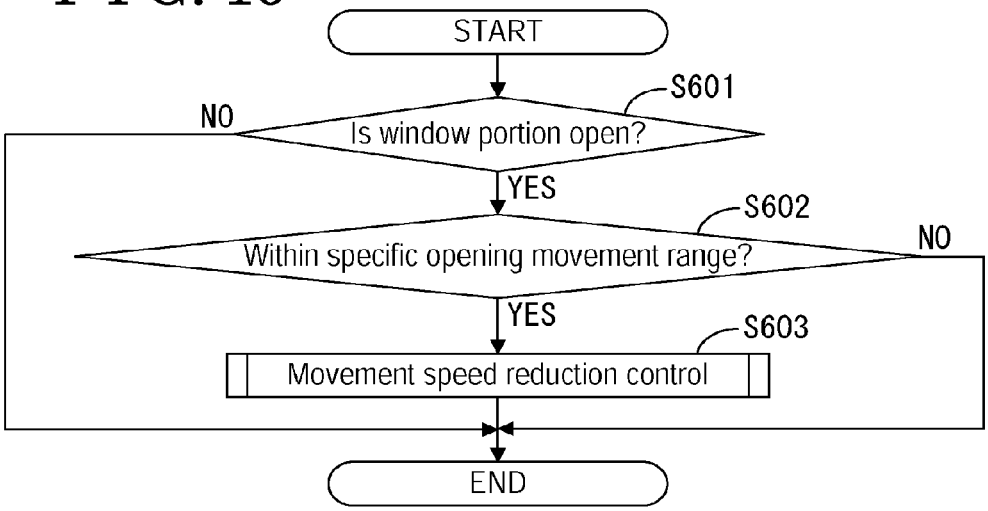
FIG. 10 is a flowchart illustrating another example of a control mode of a sliding door when a window portion is in an open state.

According to the aforementioned embodiment, in a case where the sliding door 1 of which the window portion 50 opens moves in the opening direction within the specific opening movement range R, the movement speed reduction control of the sliding door 1 may be performed. Alternatively, as shown in a flowchart in FIG. 10, in a case where the window portion 50 is in an open state (Step 601: YES), and in a case where the moved position X of the sliding door 1 is within the specific opening movement range R (Step 602: YES), the movement speed reduction control of the sliding door 1 may be performed irrespective of the movement direction of the sliding door 1 (Step 603).

According to the aforementioned embodiment, in a case where the moved position X of the sliding door 1 is close to the fully-open position Xo relative to the specific opening movement range R, the movement speed reduction control is not performed. Alternatively, the specific opening movement range R may be extended to the fully-closed position Xo. Accordingly, the extraneous material may be further inhibited from being caught caused by the sliding door 1 that moves in the opening direction while the window portion 50 is open.

According to the aforementioned embodiment, because the sliding door 1 is applied with a load so as not to move by the turning on of the electromagnetic clutch 42 provided at the drive device 11, the door ECU 20 performs the movement speed reduction control and the pre-entrance stop control of the sliding door 1. Alternatively, the sliding door 1 may be applied with a load so as not to move by a regenerative brake control and a motor control of an energized phase fixed control. Accordingly, even in a case where the drive device 11 does not include the electromagnetic clutch 42, the movement speed reduction control or the pre-entrance stop control of the sliding door 1 may be performed.

According to the aforementioned embodiment, the opening and closing body control device (the power sliding door 30) for the vehicle includes the moved position detecting portion (the door ECU 20) detecting the moved position (X, X1, X2) of the opening and closing body (1) being provided at the opening portion of the vehicle body (2), the drive control portion (the door ECU 20) operating a drive control of the opening and closing body (the sliding door 1) by controlling the operation of the drive device (11), the window portion open state determination portion (the door ECU 20) determining whether the window portion (50) being provided at the opening and closing body (the sliding door 1) is in an open state, and the moved position determination portion (the door ECU 20) determining whether the moved position (X, X1, X2) of the opening and closing body (the sliding door 1) is within the preset specific opening movement range (R). The drive control portion (the door ECU 20) performs the movement speed reduction control reducing the movement speed of the opening and closing body (the sliding door 1) so as not to exceed a predetermined speed in a case where the moved position (X, X1, X2) of the opening and closing body (the sliding door 1) is within the specific opening movement range (R).

According to the aforementioned construction, the door ECU 20 may inhibit the extraneous material disposed between the window frame 52 of the window portion 50 that is in an open state and the vehicle body 2 from being caught when the sliding door 1 moves in the opening direction. The gripping force, or the pressing force may be reduced even in a case where the extraneous material is caught. Because the door ECU 20 does not retain the position of the sliding door 1, the door ECU 20 may release the catch easily. Even in a case where the window portion 50 is in an open state, the door ECU 20 may move the sliding door 1 in the opening direction slowly while checking, without operating a special operation, that the extraneous material is not caught. As a result, the door ECU 20 may enhance the convenience of the sliding door 1 while inhibiting the catch occurred when the sliding door 1 moves in the opening direction while the window portion 50 is open.

According to the aforementioned embodiment, the drive control portion (the door ECU 20) performs the movement speed reduction control in a case where the opening and closing body (the sliding door 1) moves in the opening direction.

That is, in a case where the sliding door 1 moves in the closing direction, the extraneous material is rarely caught between the window frame 52 of the window portion 50 that is in an open state and the vehicle body 2. Thus, the convenience of the sliding door 1 may be further enhanced.

According to the aforementioned embodiment, the drive control portion (the door ECU 20) does not perform the movement speed reduction control in a case where the moved position (X, X1, X2) of the opening and closing body (1) is close to the fully-open position (Xo) relative to the specific opening movement range (R).

That is, because the sliding door 1 moves close to the fully-open position Xo and the space between the window frame 52 of the window portion 50 that is in an open state and the vehicle body 2 comes to be narrow, the extraneous material is rarely caught. Thus, according to the aforementioned embodiment, the door ECU 20 may move the sliding door 1 to the fully-open position Xo quickly while inhibiting the extraneous material from being caught. Thus, the convenience of the sliding door 1 is further enhanced.

According to the aforementioned embodiment, the drive control portion (the door ECU 20) does not perform an opening drive control of the opening and closing body (the sliding door 1) in response to an input of an opening movement request in a case where the moved position (X, X1, X2) of the opening and closing body (the sliding door 1) is within the specific opening movement range (R) while the window portion (50) is open.

According to the aforementioned construction, for example, in a case where the extraneous material may be easily caught between the window frame 52 and the vehicle body 2 because, for example, the hands or the head of a passenger is out of the vehicle from the window portion 50 that is in an open state, the sliding door 1 may be prevented from being opened by an unawareness or an operation error of a user. Accordingly, the extraneous material may be inhibited from being caught by the sliding door 1.

The opening and closing body control device (the power sliding door device 30) for the vehicle further includes the catch detection portion (the door ECU 20) detecting the catch of the extraneous material, the catch caused at the opening and closing body (the sliding door 1) that moves in a closing direction. The drive control portion (the door ECU 20) performs the reverse drive control of the opening and closing body (the sliding door 1) in a case where the catch of the extraneous material is detected. In a case where the moved position (X, X1, X2) of the opening and closing body (the sliding door 1) is within the specific opening movement range (R) while the window portion (50) is open, the drive control portion (the door ECU 20) does not perform the reverse drive control even in a case where the catch of the extraneous material is detected.

According to the aforementioned construction, the extraneous material disposed between the window frame 52 of the window portion 50 that is in an open state and the vehicle body 2 may be prevented from being caught when the sliding door 1 moves in the opening direction by the reverse drive control.

According to the aforementioned embodiment, the drive control portion (the door ECU 20) performs the pre-entrance stop control stopping the opening and closing body (the sliding door 1) that moves in the opening direction, the pre-entrance stop control stopping before arriving the specific opening movement range (R) in a case where the opening and closing body (the sliding door 1) is disposed close to a fully-closed position (Xc) relative to the specific opening movement range (R) while the window portion (50) is open.

That is, because the sliding door 1 is stopped before arriving the specific opening movement range R, the extraneous material may not easily be caught by the sliding door 1 that enters into the specific opening movement range R even in a state where the window portion 50 is open. Because the door ECU 20 does not retain the position of the sliding door 1, the door ECU 20 may slowly moves the sliding door 1 in the opening direction while checking that the extraneous material is not caught without operating a special operation. Accordingly, the convenience of the sliding door 1 may be enhanced.

According to the aforementioned embodiment, the drive device (11) includes the clutch (the electromagnetic clutch 42) connecting and disconnecting the transmission of the drive force relative to the opening and closing body (the sliding door 1) while driving the opening and closing body (the sliding door 1) by the motor (10) that serves as the drive source. The drive control portion (the door ECU 20) engages the clutch (the electromagnetic clutch 42) in a case where the opening and closing body (the sliding door 1) moves equal to or faster than the predetermined speed ($\alpha$0) when the moved position (X, X1, X2) of the opening and closing body (the sliding door 1) is within the specific opening movement range (R). The drive control portion (the door ECU20) performs the movement speed reduction control by disengaging the clutch (the electromagnetic clutch 42) in a case where the opening and closing body (the sliding door 1) moves below the predetermined speed ($\alpha$0) when the moved position (X, X1, X2) of the opening and closing body (the sliding door 1) is within the specific opening movement range (R).

That is, because the door ECU 20 turns on the electromagnetic clutch 42 to connect the torque transmission passage between the motor 10 and the opening and closing drive portion 41, for example, the door ECU 20 applies a load on the sliding door 1 to inhibit the sliding door 1 from moving in response to frictional force of, for example, a cogging torque of the motor 10 or a reduction mechanism. The power sliding door device 30 may reduce the speed of the sliding door 1 that moves faster than the predetermined speed $\alpha$0.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An opening and closing body control device for a vehicle, comprising:

a moved position detecting portion detecting a moved position of an opening and closing body being provided at an opening portion of a vehicle body;

a drive control portion operating a drive control of the opening and closing body by controlling an operation of a drive device;

a window portion open state determination portion determining whether a window portion being provided at the opening and closing body is in an open state; and a moved position determination portion determining whether the moved position of the opening and closing body is within a preset specific opening movement range; wherein the drive control portion performs a movement speed reduction control reducing a movement speed of the opening and closing body so as not to exceed a predetermined speed in a case where the moved position of the opening and closing body is within the specific opening movement range, wherein the drive control portion does not perform the movement speed reduction control in a case where the moved position of the opening and closing body is close to a fully-open position relative to the specific opening movement range.

2. The opening and closing body control device for the vehicle according to claim 1, wherein the drive control portion performs the movement speed reduction control in a case where the opening and closing body moves in an opening direction.

3. The opening and closing body control device for the vehicle according to claim 1, wherein the drive control portion does not perform an opening drive control of the opening and closing body in response to an input of an opening movement request in a case where the moved position of the opening and closing body is within the specific opening movement range while the window portion is open.

4. The opening and closing body control device for the vehicle according to claim 1, further comprising:

a catch detection portion detecting a catch of an extraneous material, the catch caused at the opening and closing body that moves in a closing direction; wherein the drive control portion performs a reverse drive control of the opening and closing body in a case where the catch of the extraneous material is detected; and in a case where the moved position of the opening and closing body is within the specific opening movement range while the window portion is open, the drive control portion does not perform the reverse drive control even in a case where the catch of the extraneous material is detected.

5. The opening and closing body control device for the vehicle according to claim 1, wherein the drive control portion performs a pre-entrance stop control stopping the opening and closing body that moves in an opening direction, the pre-entrance stop control stopping before arriving the specific opening movement range in a case where the opening and closing body is disposed close to a fully-closed position relative to the specific opening movement range while the window portion is open.

6. The opening and closing body control device for the vehicle according to claim 1, wherein the drive device includes a clutch connecting and disconnecting a transmission of a drive force relative to the opening and closing body while driving the opening and closing body by a motor that serves as a drive source; and the drive control portion engages the clutch in a case where the opening and closing body moves equal to or faster than a predetermined speed when the moved position of the opening and closing body is within the specific opening movement range; and the drive control portion performs the movement speed reduction control by disengaging the clutch in a case where the opening and closing body moves below the predetermined speed when the moved position of the opening and closing body is within the specific opening movement range.

* * * * *